United States Patent [19]

Blass

[11] Patent Number: 4,988,269

[45] Date of Patent: Jan. 29, 1991

[54] COMPRESSOR DISCHARGE GAS SOUND ATTENUATION

[75] Inventor: Jaroslav Blass, Sidney, Ohio

[73] Assignee: Copeland Corporation, Sidney, Ohio

[21] Appl. No.: 476,812

[22] Filed: Feb. 8, 1990

[51] Int. Cl.[5] ..... F04B 11/00

[52] U.S. Cl. ..... 417/312; 417/542; 417/902; 181/403

[58] Field of Search ..... 417/312, 271, 273, 542, 417/902; 62/296; 181/403

[56] References Cited

U.S. PATENT DOCUMENTS

| | | | |
|---|---|---|---|
| 3,387,774 | 6/1968 | Gannaway et al. | 417/312 |
| 3,762,837 | 10/1973 | Ellis et al. | 417/902 X |
| 4,470,772 | 9/1984 | Gannaway | 417/902 X |
| 4,518,323 | 5/1985 | Elson et al. | 181/403 X |
| 4,842,492 | 6/1989 | Gannaway | 417/902 X |
| 4,929,157 | 5/1990 | Steele et al. | 417/312 |

*Primary Examiner*—Leonard E. Smith
*Assistant Examiner*—Eugene L. Szczecina, Jr.
*Attorney, Agent, or Firm*—Harness, Dickey & Pierce

[57] ABSTRACT

A hermetic motor-compresosr having separate discharge cavities in the compressor body for each pumping cylinder, a common discharge gas plenum for the entire compressor, and an impedance tube between each cavity and said plenum, thereby signficantly improving the sound attentuation of discharge gas pulses.

18 Claims, 3 Drawing Sheets

COMPRESSOR DISCHARGE GAS SOUND ATTENUATION

BACKGROUND AND SUMMARY OF THE INVENTION

The present invention relates to compressors and more particularly to refrigerant compressors having improved discharge gas sound attenuation.

In the case of refrigerant compressors used for air conditioning and heat pump applications, sound has become an increasingly important criteria for judging acceptability. Accordingly, there is a demand for improved refrigerant compressors which are quieter than those presently available, but sacrificing none of the advantages of existing compressors.

It is therefore a primary object of the present invention to provide a refrigerant compressor having improved sound attenuation which is relatively simple in construction, and does not result in a significant loss of efficiency. The compressor of the present invention is an improvement over that disclosed in assignee's U.S. Letters Patent 3,807,907, the entire disclosure of which is herein incorporated by reference.

Other advantages and features will become apparent from the following specification taken in connection with the accompanying drawings.

DESCRIPTION OF THE PREFERRED EMBODIMENT

Figure 1:
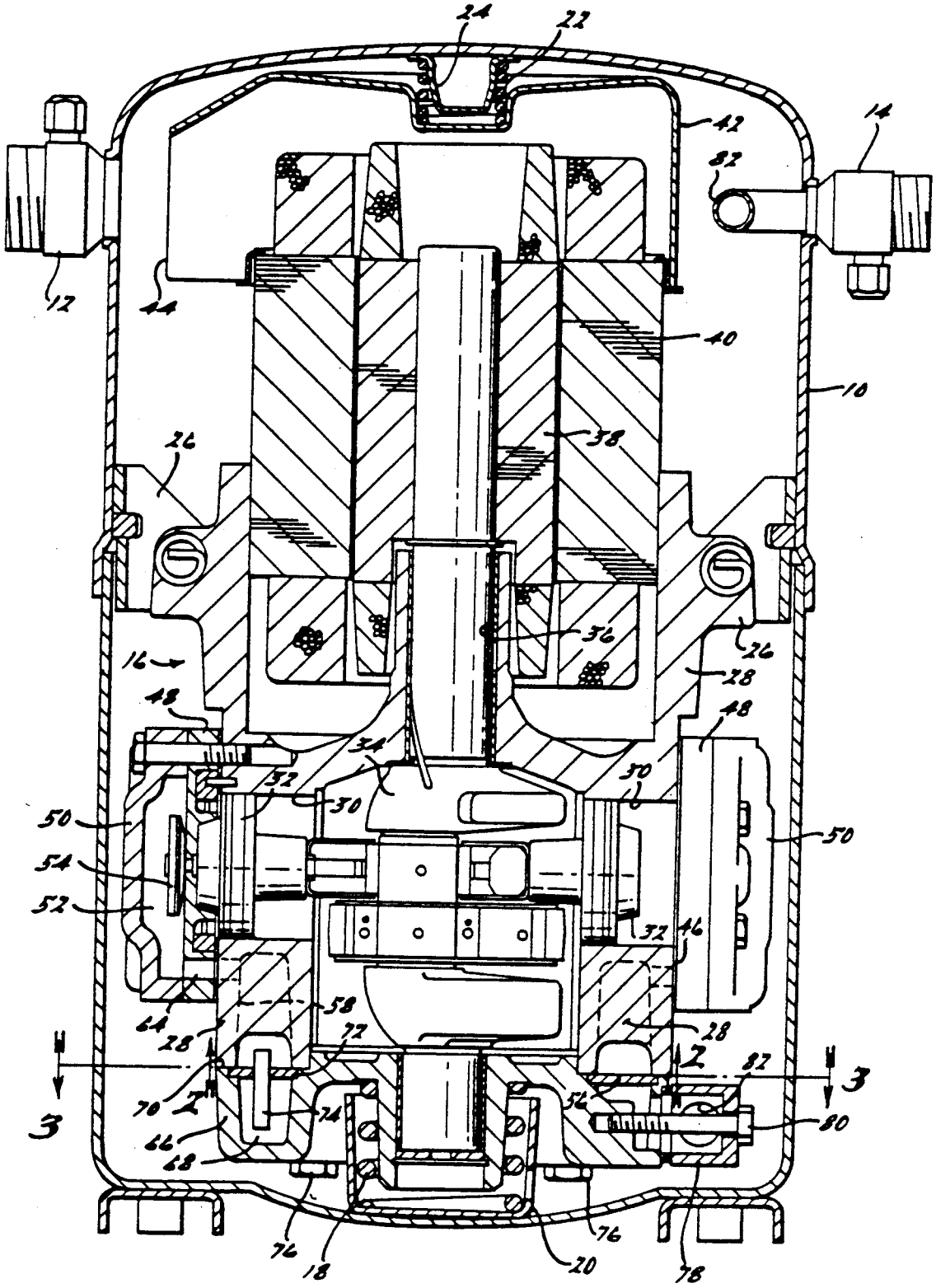
FIG. 1 is a vertical sectional view of a multi-cylinder hermetic refrigerant compressor embodying the principles of the present invention.

The present invention is illustrated for exemplary purposes embodied in a four cylinder scotch-yoke reciprocating compressor. The major components of the compressor include a hermetic shell 10, a suction gas inlet fitting 12, a discharge gas outlet fitting 14, and a motor-compressor unit 16 disposed therein and supported by a suspension spring 18 disposed within a cup 20 at the bottom of shell 10 and positioned at the upper end by means of a spring 22 located on a sheet metal projection 24. Rotation of the motor compressor unit is restrained by means of a anti-torsion spring assemblies 26. The motor compressor unit 16 generally comprises a compressor body 28 defining a plurality of pumping cylinders 30 (4 equally spaced radially disposed cylinders in this case), in each of which is disposed a reciprocating pumping member in the form of a piston 32 connected in the usual scotch-yoke manner to a crankshaft 34 rotationally journalled in a bearing 36 disposed in body 28. The upper end of crankshaft 34 is affixed to a motor rotor 38 rotatively disposed within a motor stator 40, the upper end of which is provided with a motor cover 42 which engages spring 22 and has an open end 44 adapted to receive suction gas entering through fitting 12 for purposes of motor cooling prior to induction into the compressor. Up to this point the compressor as described is known in the art and all the details thereof are disclosed in the aformentioned U.S. Letters Patent which is incorporated herein by reference.

The novel features of the present invention reside in the construction of the lower portion of body 28 and the accessories attached thereto. As best seen in FIG. 1, each cylinder 30 in body 28 is opened to an outer planar surface 46 on body 28 to which is bolted the usual valve plate assembly 48 and cylinder head 50, all in the usual manner. Each cylinder head 50 defines a discharge gas chamber 52 which receives the discharge gas pumped by the compressor through discharge valve assembly 54. All of the cylinder assemblies are constructed in the same manner.

Figure 2:
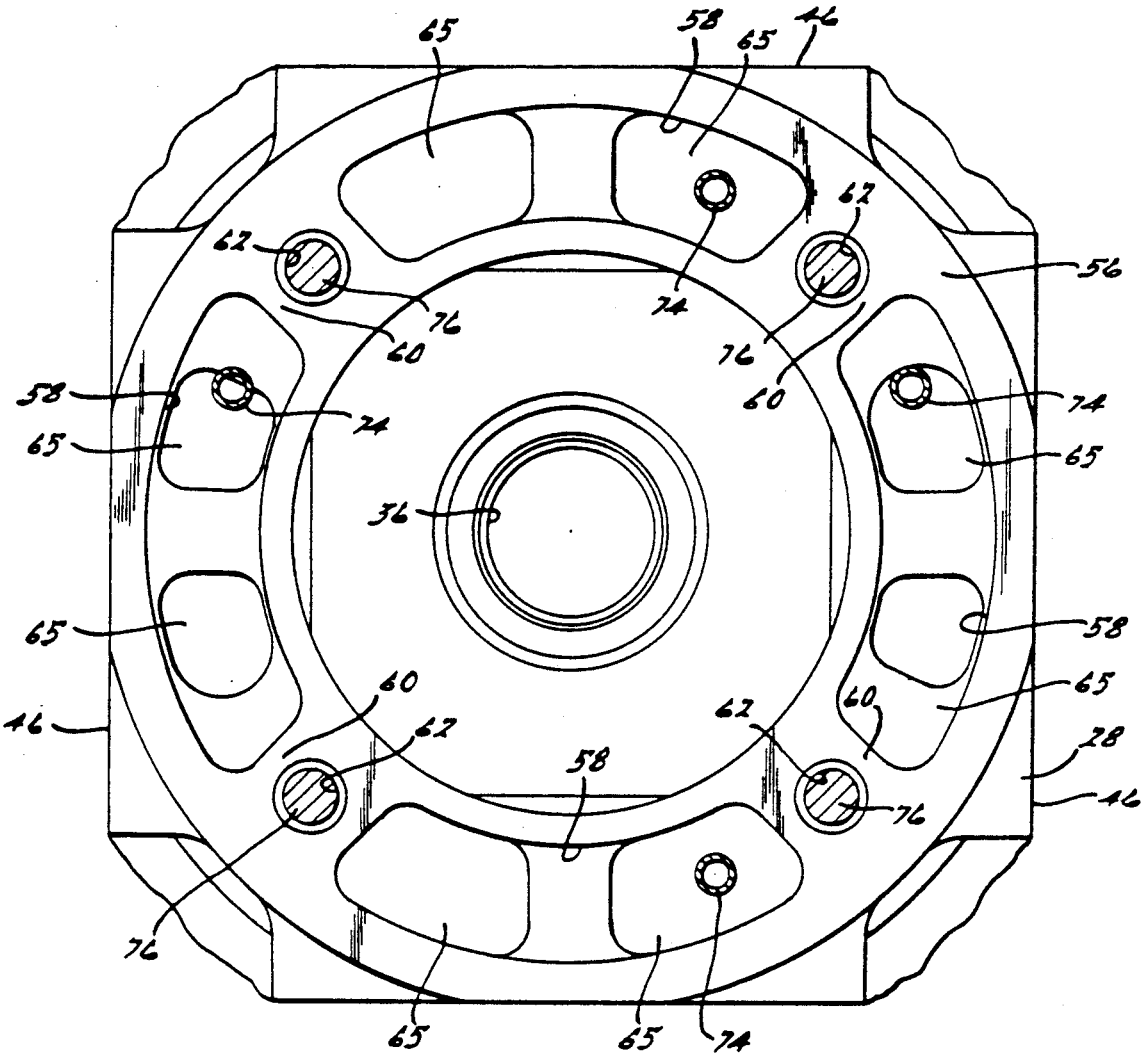
FIG. 2 is a sectional view taken substantially along line 2—2 in FIG. 1.

As best seen in FIGS. 1 and 2, the lower end of body 28 has a generally Planar surface 56 which is annular in configuration and is provided with a plurality of substantially equally spaced arcuate cavities 58, one for each cylinder and in general alignment therewith. Each of the cavities 58 is separated one from the other by a web portion 60 in body 28 which is provided with a threaded hole 62. Each cavity 58 communicates via a passageway 64 (FIG. 1) with a corresponding discharge chamber 52. (Note that passageway 64 goes through a portion of body 28 and valve plate assembly 48). To increase cavity volume for greater sound attenuation each cavity has one or more risers 65 which extend up into unused portions of the body casting.

Figure 3:
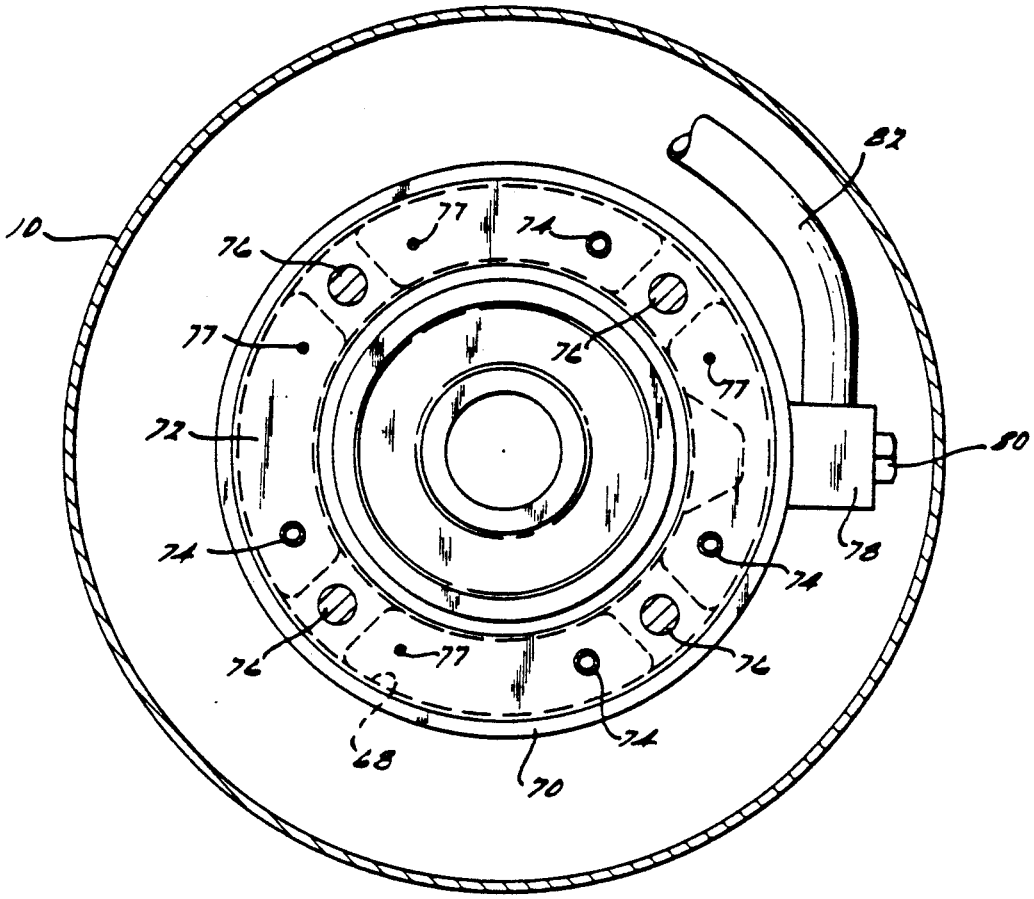
FIG. 3 is a sectional view taken substantially along line 3—3 in FIG. 1.
Figure 4:
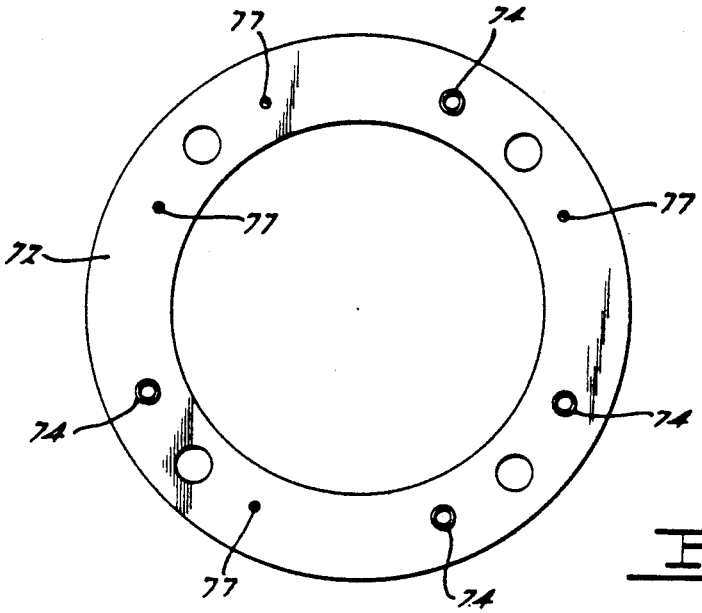
FIG. 4 is top plan view of an annular partition forming a part of the present invention.

Overlying end surface 56 is a plenum member 66 defining a single annular plenum 68 which overlies all of the cavities 58 (see FIGS. 1 and 3). The upper surface of plenum member 66 is generally planar, as indicated at 70 and for the most part engages end surface 56 on body 28. Surface 70 is relieved along the periphery of plenum 68, as at 69, to define a recess of cross-sectional configuration in which is sealingly disposed an annular partition ring 72 having a plurality of impedence tubes 74 of uniform diameter extending therethrough. Partition 72 is clamped between plenum member 66 and body 28 by a plurality of bolts 76 which pass through plenum 68 and partition 72 and threadably engage threaded holes 62 in body 28.

The upper end of each impedence tube 74 extends into a single one of the cavities 58 and because partition 72 is imperforate except for where the impedence tubes 74 pass and bolts 76 pass therethrough, and except for several very small oil drain holes 77 which do not effect sound attenuation, the impedence tubes constitute the sole means for communicating discharge gas from each cavity 58 to plenum 68. Each of the plenum tubes 74 is of substantially equal length and inside diameter and this length and diameter are chosen in order to obtain maximum attenuation of the peak frequencies of the discharge gas pulses leaving each of the pumping chambers. The volumes of cavities 58 and plenum 68, and the cicumferential length of cavities 58, are similarly chosen, all in accordance with known criteria. As best seen in FIG. 3, each impedence tube 74 is located adjacent one end of the cavity 58 in which it is disposed, and each of the cavities has relatively flat end walls. These features are believed to further maximize the degree of attenuation achieved with the present invention.

The discharge gas in plenum 68 flows outwardly therefrom through a fitting 78 which is bolted to plenum member 68 by means of a bolt 80 and places plenum 66 in fluid communication with a discharge line 82 which winds its way through the space between the motor-compressor and shell 10 until it reaches and is connected to discharge fitting 14.

As thus can be visualized, the discharge gas flowing from discharge chamber 52 via passageway 64 first flows into an attenuating expansion chamber in the form of cavity 58. From there it flows through an impedence tube 74 in which there is created the usual standing wave for further attenuation and into common discharge plenum 68 from which it flows through fitting 78 and discharge tube 82 to outside of the shell via fitting 14. It has been discovered that the attenuation achieved with the construction of the present invention is a signficant improvement over the prior design and that it yields its benefits without any significant loss of efficiency. Furthermore, it should be noted that the advantages of the present invention may be achieved with other than reciprocating type compressors, such as, for example, rotary, vane and other compressors having plural pumping chambers.

While it will be apparent that the preferred embodiments of the invention disclosed are well calculated to provide the advantages above stated, it will be appreciated that the invention is susceptible to modification variation and change without departing from the proper scope or fair meaning of the subjoined claims.

What is claimed is:

1. A hermetic compressor with discharge gas sound attenuation, comprising:

(a) a hermetic shell;

(b) a motor mounted in said shell;

(c) a compressor mounted in said shell, said compressor having a plurality of pumping cylinders, each having an inlet and an outlet and having disposed therein a pumping member powered by said motor;

(d) inlet means for placing a source of suction gas in fluid communication with each said inlet;

(e) a cylinder head associated with each said cylinder and having a discharge chamber therein for receiving pumped discharge gas from said outlet;

(f) a body having a plurality of separate cavities therein, each cavity having an inlet opening in fluid communication with only one of said discharge chambers;

(g) a discharge gas plenum member defining a single discharge gas plenum in communication with all of said cavities;

(h) a partition disposed between each said cavity and said plenum., (i) an impedence tube extending through said partition with one end extending into said cavity and the opposite end extending into said plenum, said impedence tube being the sole means of fluid communication between said cavity and said plenum; and (j) outlet means for communicating discharge gas from said plenum to outside of said shell.

2. A hermetic compressor with discharge gas sound attenuation, comprising:

(a) a hermetic shell;

(b) a motor mounted in said shell;

(c) a compressor mounted in said shell, said compressor having a plurality of pumping cylinders, each having an inlet and an outlet and having disposed therein a pumping member powered by said motor;

(d) inlet means for placing a source of suction gas in fluid communication with each said inlet;

(e) a cylinder head associated with each said cylinder and having a discharge chamber therein for receiving pumped discharge gas from said outlet;

(f) a body having a generally planar end face and a plurality of separate cavities therein open to said end face, each cavity having an inlet opening in fluid communication with only one of said discharge chambers;

(g) a discharge gas plenum member having a generally planar end face disposed in a facing relationship to said body end face, and defining a single discharge gas plenum open to said end face and overlying all of said cavities;

(h) a generally planar partition disposed between and sealingly engaging said end faces;

(i) a plurality of impedence tubes extending through said partition. each of said impedence tubes extending at one end into a single one of said cavities and at the opposite end into said plenum, said impedence tubes being the sole means of fluid communication between said cavities and said plenum; and (j) outlet means for communicating discharge gas from said plenum to outside of said shell.

3. A hermetic compressor as claimed in claim 2 wherein said cylinders are defined by said body.

4. A hermetic compressor as claimed in claim 3 wherein said cylinders are circumferentially disposed about a center axis.

5. A hermetic compressor as claimed in claim 4 wherein said cavities are circumferentially disposed about said axis.

6. A hermetic compressor as claimed in claim 5 wherein said plenum is annular in configuration.

7. A hermetic compressor as claimed in claim 6 wherein said partition is annular in configuration.

8. A hermetic compressor as claimed in claim 3 wherein said impedence tubes are of equal length.

9. A hermetic compressor as claimed in claim 3 wherein said impedence tubes are disposed generally parallel to said axis.

10. A hermetic compressor as claimed in claim 3 wherein said impedence tubes are of uniform diameter from end to end.

11. A hermetic compressor as claimed in claim 3 further comprising securing means for securing said plenum member to said body and clamping said partition therebetween.

12. A hermetic compressor as claimed in claim 11 wherein said securing means comprises a plurality of bolts extending through said plenum member and said partition and threadably engaging said body at points between said cavities.

13. A hermetic compressor as claimed in claim 3 wherein an internal passage in said body places each of said chambers in fluid communication with a single one of said cavities.

14. A hermetic compressor as claimed in claim 3 wherein said cavities are elongated in one dimension.

15. A hermetic compressor as claimed in claim 14 wherein the end walls of each said cavity are generally flat.

16. A hermetic compressor as claimed in claim 15 wherein said one end of each of said impedence tubes is disposed adjacent one end of the cavity in which it is disposed.

17. A hermetic compressor as claimed in claim 14 wherein said one end of each of said impedence tubes is disposed adjacent one end of the cavity in which it is disposed.

18. A hermetic compressor as claimed in claim 3 wherein each of said impedence tubes is of the same inside diameter.

* * * * *

UNITED STATES PATENT AND TRADEMARK OFFICE

CERTIFICATE OF CORRECTION

PATENT NO. : 4,988,269

DATED : January 29, 1991

INVENTOR(S) : Jaroslav Blass

It is certified that error appears in the above-identified patent and that said Letters Patent is hereby corrected as shown below:

In the Abstract: "motor-compresosr" should be -- motor-compressor --.

In the Abstract: "signficantly" should be -- significantly --.

Column 1, line 53, delete "a".

Column 2, lines 15-16, after "generally" delete indication of new paragraph.

Column 2, line 16, "Planar" should be -- planar --.

Column 2, line 38, "impedence" should be -- impedance --.

Column 2, line 44, "impedence" should be -- impedance --.

Column 2, line 46, "impedence" should be -- impedance --.

Column 2, line 49, "impedence" should be -- impedance --.

Column 2, line 57, "cicumferential" should be -- circumferential --.

Column 2, line 59, "impedence" should be -- impedance --.

UNITED STATES PATENT AND TRADEMARK OFFICE

CERTIFICATE OF CORRECTION

PATENT NO. : 4,988,269

DATED : January 29, 1991

INVENTOR(S) : Jaroslav Blass

It is certified that error appears in the above-identified patent and that said Letters Patent is hereby corrected as shown below:

Column 3, line 6, "impedence" should be -- impedance --.

Column 3, line 13, "signficant" should be -- significant --.

Column 3, line 47, "." should be -- ; --.

Column 3, line 48, "impedence" should be -- impedance --.

Column 3, line 51, "impedence" should be -- impedance --.

Column 4, line 13, "impedence" should be -- impedance --.

Column 4, line 14, "." should be -- , --.

Column 4, line 14, "impedence" should be -- impedance --.

Column 4, lines 16-17, "impedence" should be -- impedance --.

Column 4, line 33, "impedence" should be -- impedance --.

Column 4, line 35, "impedence" should be -- impedance --.

UNITED STATES PATENT AND TRADEMARK OFFICE

CERTIFICATE OF CORRECTION

PATENT NO. : 4,988,269

DATED : January 29, 1991

INVENTOR(S) : Jaroslav Blass

It is certified that error appears in the above-identified patent and that said Letters Patent is hereby corrected as shown below:

Column 4, line 38, "impedence" should be -- impedance --.

Column 4, line 58, "impedence" should be -- impedance --.

Column 4, line 62, "impedence" should be -- impedance --.

Column 4, line 66, "impedence" should be -- impedance --.

Signed and Sealed this

Twenty-ninth Day of December, 1992

*Attest:*

DOUGLAS B. COMER

*Attesting Officer*

*Acting Commissioner of Patents and Trademarks*